US010601171B1

(12) United States Patent
Lin

(10) Patent No.: US 10,601,171 B1
(45) Date of Patent: Mar. 24, 2020

(54) TAIL SLEEVE STRUCTURE OF NETWORK SIGNAL CONNECTOR

(71) Applicant: JYH ENG TECHNOLOGY CO., LTD., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/406,039

(22) Filed: May 8, 2019

(51) Int. Cl.
*H01R 13/58* (2006.01)
*H01R 12/70* (2011.01)
*H01R 13/40* (2006.01)

(52) U.S. Cl.
CPC ..... *H01R 13/5812* (2013.01); *H01R 12/7005* (2013.01); *H01R 13/40* (2013.01); *H01R 13/582* (2013.01)

(58) Field of Classification Search
CPC ..... H01R 12/7005; H01R 13/5812
USPC ..... 439/460, 467, 469
See application file for complete search history.

(56) References Cited

U.S. PATENT DOCUMENTS 5,511,993 A * 4/1996 Yamada ..... H01R 9/0524 439/607.5
5,514,007 A * 5/1996 Rodrigues ..... H01R 13/5837 439/449
6,126,478 A * 10/2000 Presson ..... H01R 13/595 439/467
6,168,476 B1 * 1/2001 Yang ..... H01R 13/506 439/352
6,478,609 B1 * 11/2002 Davis ..... H01R 13/5812 439/465
7,201,604 B1 * 4/2007 Amidon ..... H01R 13/5825 439/418
7,938,674 B2 5/2011 Lindkamp et al.
8,246,377 B2 8/2012 Lindkamp et al.
8,702,444 B2 * 4/2014 Maranto ..... H01R 24/64 439/467
9,219,331 B1 * 12/2015 Liao ..... H01R 13/506
9,461,400 B2 * 10/2016 Kanda ..... H01R 13/5829
10,116,083 B2 * 10/2018 Lin ..... H01R 13/5025
2010/0255711 A1 * 10/2010 Jenving ..... H01R 13/512 439/452
2013/0102185 A1 * 4/2013 Mulfinger ..... H01R 13/516 439/460
2015/0280349 A1 * 10/2015 Thelen ..... H01R 13/502 439/701
2015/0280360 A1 10/2015 Thelen

FOREIGN PATENT DOCUMENTS

TW M486185 9/2014

* cited by examiner

*Primary Examiner* — Tulsidas C Patel
*Assistant Examiner* — Marcus E Harcum
(74) *Attorney, Agent, or Firm* — Fei-hung Yang

(57) ABSTRACT

A tail sleeve structure of a network signal connector includes a main body and a pair of propping structures. The main body has a penetrating passage in the middle, a pair of rails symmetrically installed on the inner wall surface of the penetrating passage, an opening formed at the diagonal positions of the end surface of the pair of rails respectively, and two mounting holes formed at the other diagonal positions respectively. Each propping structure includes a propping pillar and an elastic element movably installed into the mounting hole.

8 Claims, 5 Drawing Sheets

TAIL SLEEVE STRUCTURE OF NETWORK SIGNAL CONNECTOR

FIELD OF THE INVENTION

The present invention relates to the field of a network signal device, more particularly to a tail sleeve structure of a network signal connector capable of improving the convenience of operation greatly and preventing the connector from falling out effectively by an operational design similar to that of a Bayonet Neill-Concelman (BNC) connector.

BACKGROUND OF THE INVENTION

Description of the Related Art

In general, a traditional network cable has 8 core wires which are stranded into four pairs of core wires, wherein the first pair includes a white-orange wire and an orange wire, the second pair includes a white-green wire and a green wire, the third pair includes a white-blue wire and a blue wire, and the fourth pair includes a white-brown wire and a brown wire, and these four pairs of branded wires are distinguished by the aforementioned colors. However, the way of arranging the core wires specified in the network specification follows the T568A or B wire positions. In the arrangement of wires, we can see a green pair of branded wires and a blue pair of branded wires, which are not arranged according to the sequence, and thus it leads to interference or crosstalk between the core wires in network properties due to the aforementioned two pairs of branded wires. Therefore, the metal plates of the network signal connector at the network jumper end provided for connection are arranged into 1-8 rows. The core wires are plugged into the metal plates according to the sequence to complete the electrical connection. Since the second pair and the third pair of core wires are staggered, therefore the electrical characteristic cannot be enhanced. Related patents are disclosed to overcome this issue. A printed circuit board (PCB) collocated with a piercing terminal (IDC terminal) are used for connecting a network cable to enhance the jumper property of the network signal connector. For high-frequency network cables, the wire diameter is increased, so that these network cables also need to have the aforementioned network signal connector. However, the following problem arises. If the tail sleeve structure at the rear end of the network signal connector used for fixing the network cable fits a network cable of a larger diameter, then the gap between the tail sleeve structure and the network cable will be too large when the same network signal connector is used for a network cable of a smaller diameter. Obviously, this connector fails to provide the required protection effect.

To overcome the aforementioned problem, many users change the method of using the tail sleeve structure for connectors into a screw connection method, and the clamping element inside the connector is used for clamping the network cable as disclosed in U.S. Pat. No. 7,938,674 entitled "Cable clamp with clamping element", and this patent discloses that a thread and a bump are disposed at a tail sleeve structure of a network signal connector, so that after a network cable is installed into the network signal connector, the network cable is aligned with the bump position at the tail sleeve structure of the network signal connector, and then installed to the corresponding tail sleeve structure of the network signal connector through a clamping element on a slope, and a pressure screw is provided for displacing the clamping element, so that the bump is propped and pressed by the slope of the clamping element and retracted towards the center to achieve the effect of clamping the network cable. In addition, U.S. Pat. No. 8,246,377 entitled "Connector housing with integrated cable clamp" discloses another tail sleeve design to overcome the drawback of having an extra component, and this patent has an external thread structure designed at the tail end of the network signal connector, and the external thread has a cantilever with a protruding slope, and a nut is used to secure the tail end of the network signal connector to the externa thread, so that the nut can prop and press the protruding slope of the cantilever to retract the free end of the front end inwardly, so as to achieve the effect of clamping the network cable. In addition, R.O.C. Pat. No. M486185 entitled "Connector module and protective cover thereof" discloses a protective cover, and a thread structure at the tail end of a network signal connector designed in form of a cantilever, and an end of a nut designed in an slightly retracted manner, so that when the nut is secured to the thread structure at the tail end of the network signal connector, the retracted area of the nut is provided for propping the free end of the cantilever, so that the free end is retracted inwardly to clamp the network cable. Further, U.S. Pat. No. 20150280360 entitled Electrical plug connector" also discloses a tail sleeve design secured by screws, wherein a propping bump structure is designed on an inner side of the tail end of the network signal connector, and a guide rail slot is designed on both sides of the propping bump separately, and a clamp disposed at a position corresponding to the guide rail slot has two rails, and the tail end design is a pressing block matched with the propping bump, and a nut is provided for securing the tail end of the network signal connector and driving the clamp to move inwardly, so that the propping bump squeezes the pressing block of the clamp to retract towards the center, so as to achieve the effect of clamping the network cable. In addition, U.S. Pat. No. 8,246,377 and R.O.C. Pat. No. M486185 have reduced the number of components as used in U.S. Pat. No. 7,938,674, but another problem remains. To achieve the retracting effect of the cantilever structure, both thread and cantilever must be made of a material such as plastic with a better extensibility, and such material with good extensibility has a relatively weaker rigidity and may be malfunctioned or damaged easily once if it is pulled by a large force.

In addition, the aforementioned tail sleeve structure is collocated with the thread nut, and this structural design has a good internal compact effect, but the major drawback is that it requires a large force to rotate the nut when a cable of a different diameter (particularly a cable with a larger diameter) is used. Another drawback is that it requires some time to rotate and secure the tail sleeve. For a small quantity, the nuts can be rotated and secured one by one; but for a large quantity, a tool is preferred to assist the installation, and the tool generally has a risk of damaging the overall housing or affecting the property and external appearance adversely.

Therefore, the inventor of the present invention intends to overcome the difficulty of assembling a tail sleeve with a large diameter by learning from the design of the Bayonet Neill-Concelman (BNC) piercing type connector and designing an end of a network signal connector into a shape corresponding to that of the tail sleeve, so that the locking operation can be completed quickly after the rotation to a specific angle, and this invention can improve the convenience of operation significantly and preventing the connected network cable from falling out.

SUMMARY OF THE INVENTION

Therefore, it is a primary objective of the present invention to overcome the drawbacks of the prior art by providing a tail sleeve structure of a network signal connector, wherein the tail sleeve structure is secured to the relative positions of a main body and a clamshell of the network signal connector by using a foaming process, so as to prevent a network cable from being loosened or falling out from the network signal connector, and such structure not just improves the convenience of operation only, but also prevents the connected network cable from falling out.

To achieve the aforementioned objective, the present invention discloses a tail sleeve structure of a network signal connector, wherein the network signal connector comprises a main body and a clamshell, and a front end of the main body has a connecting portion configured to be corresponsive to a network signal socket, and a wire clamp base and a seal cover disposed inside the main body and configured to be corresponsive to a network cable and provided for clamping and fixing the network cable, and after the clamshell at the top of the main body is shut, the wire clamp base and the seal cover are pressed to fix the network cable into a position, and after the main body and the clamshell are combined to form a circular tubular passage corresponding to the network cable, a pair of protruding pillars are symmetrically disposed outside the circular tubular passage and the tail sleeve is provided for locking the main body and the clamshell and preventing loosening and separation, and the rear cover structure comprises: a main body, including a sleeve-shaped structure with a penetrating passage in the middle and configured to be corresponsive to the circular tubular passage, so that the penetrating passage can be sheathed on the circular tubular passage, and the penetrating passage has a pair of rails disposed on the inner wall surface of the penetrating passage and configured to the pair of protruding pillars respectively, and each rail has an opening formed on an end surface of the main body corresponding to the network signal connector, so that the pair of openings are disposed at the diagonal positions of the main body respectively, and two mounting holes are formed at the other diagonal positions of the main body respectively; and a pair of propping structures, each including a propping pillar and an elastic element, and movably installed into the mounting hole, and the front end of each propping pillar being exposed from a surface of the main body by means of the resilience of the elastic element; during assembling, after the two protruding pillars are aligned precisely and respectively to the two openings of the tail sleeve and pressed, the two protruding pillars are move along the extending direction of each rail, and the penetrating passage is sheathed on the circular tubular passage precisely, and after the tail cap is rotated to a predetermined angle, the two protruding pillars are engaged into the two rails, and the elastic force of the two propping structures presses on the main body to define a secured lock.

In an embodiment, each rail has a clamping portion disposed therein and configured to be corresponsive to the predetermined angle when the tail cap is rotated, so that after the tail cap has rotated to the predetermined angle, the two protruding pillars fall into the two clamping portions to define an engagement. In addition, each clamping portion is bent from the rail to an extending distance of the predetermined angle to forma receiving groove in a shape corresponding to the shape of the protruding pillar, and the predetermined angle falls within a range from 40 degrees to 85 degrees.

In another embodiment, the penetrating passage is in a shape corresponding to the external shape of the circular tubular passage, and the penetrating passage has a ring-shaped stop portion disposed therein and configured to be corresponsive to the length of the circular tubular passage. In addition, the exterior of the main body is designed in a substantially rectangular shape and configured to be corresponsive to an end of the main body, and an end in where the network cable passes is designed in a substantially tubular shape, and each surface of the main body has a plurality of ribs disposed thereon.

DESCRIPTION OF THE PREFERRED EMBODIMENTS

The above and other objects, features and advantages of this disclosure will become apparent from the following detailed description taken with the accompanying drawings.

Figure 1:
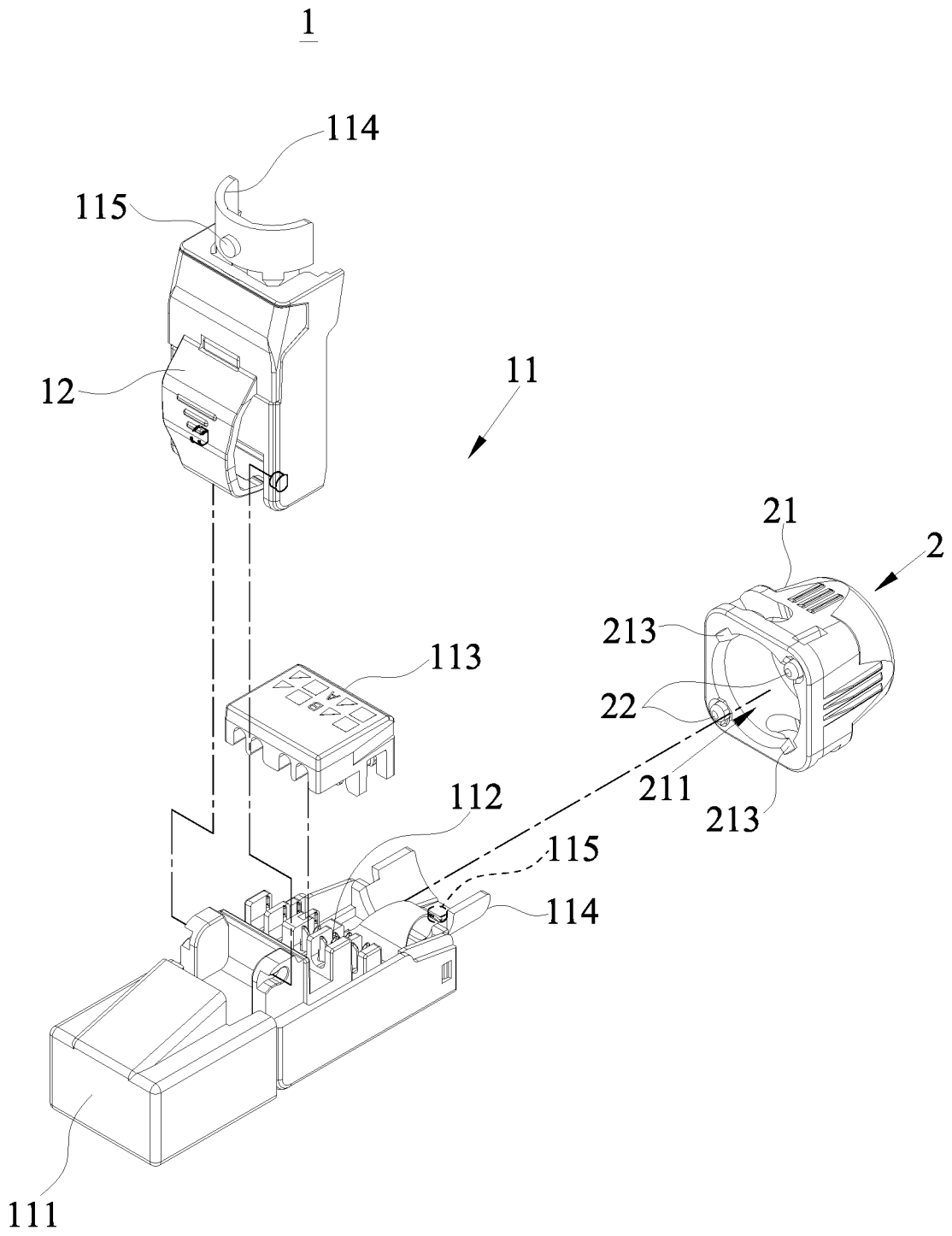
FIG. 1 is a schematic view of a preferred embodiment of the present invention during assembling.
Figure 2:
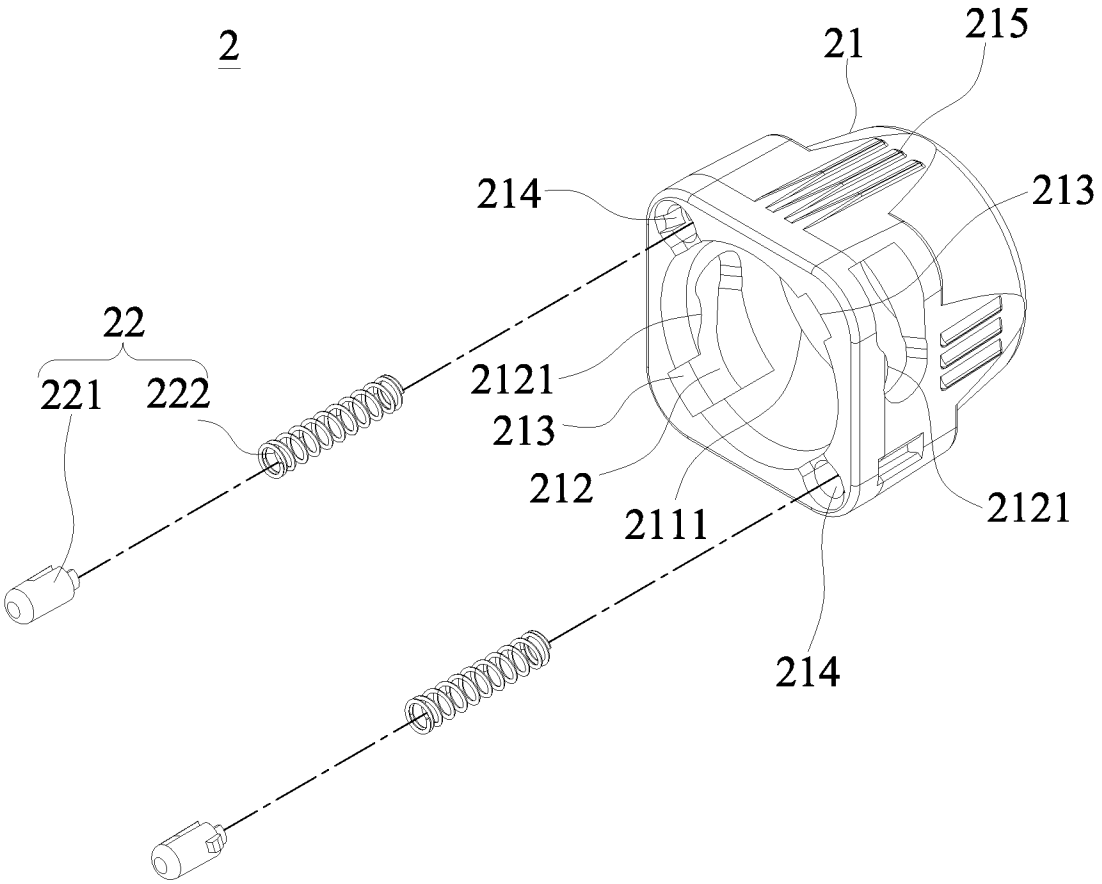
FIG. 2 is a perspective exploded view of a preferred embodiment of the present invention.
Figure 3:
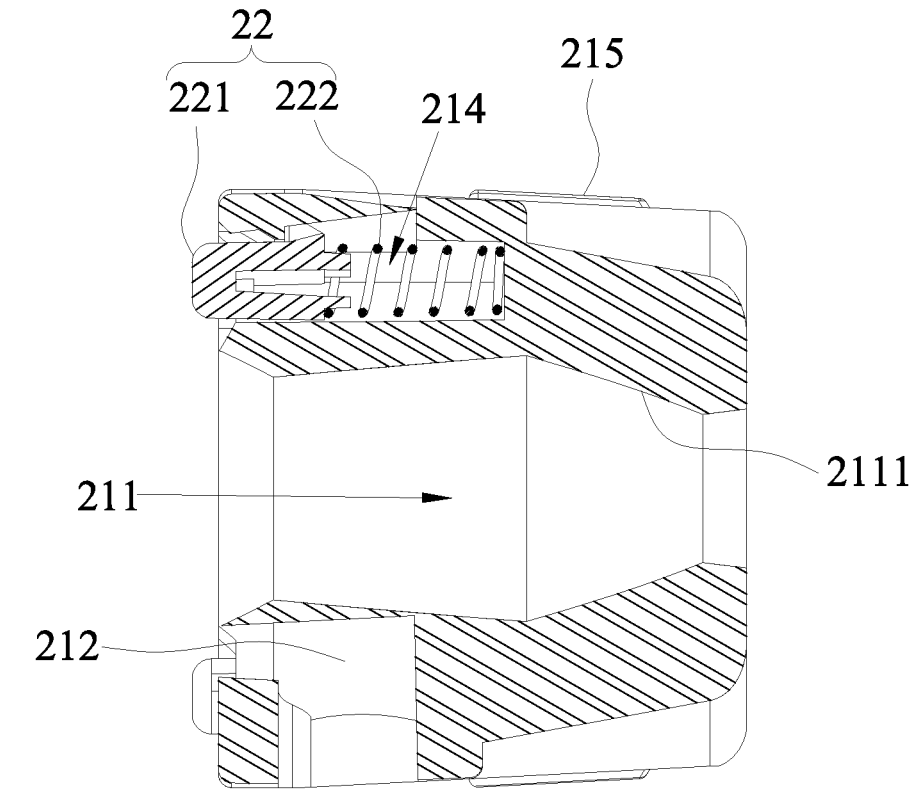
FIG. 3 is a cross-sectional view of a preferred embodiment of the present invention after assembling.
Figure 4:
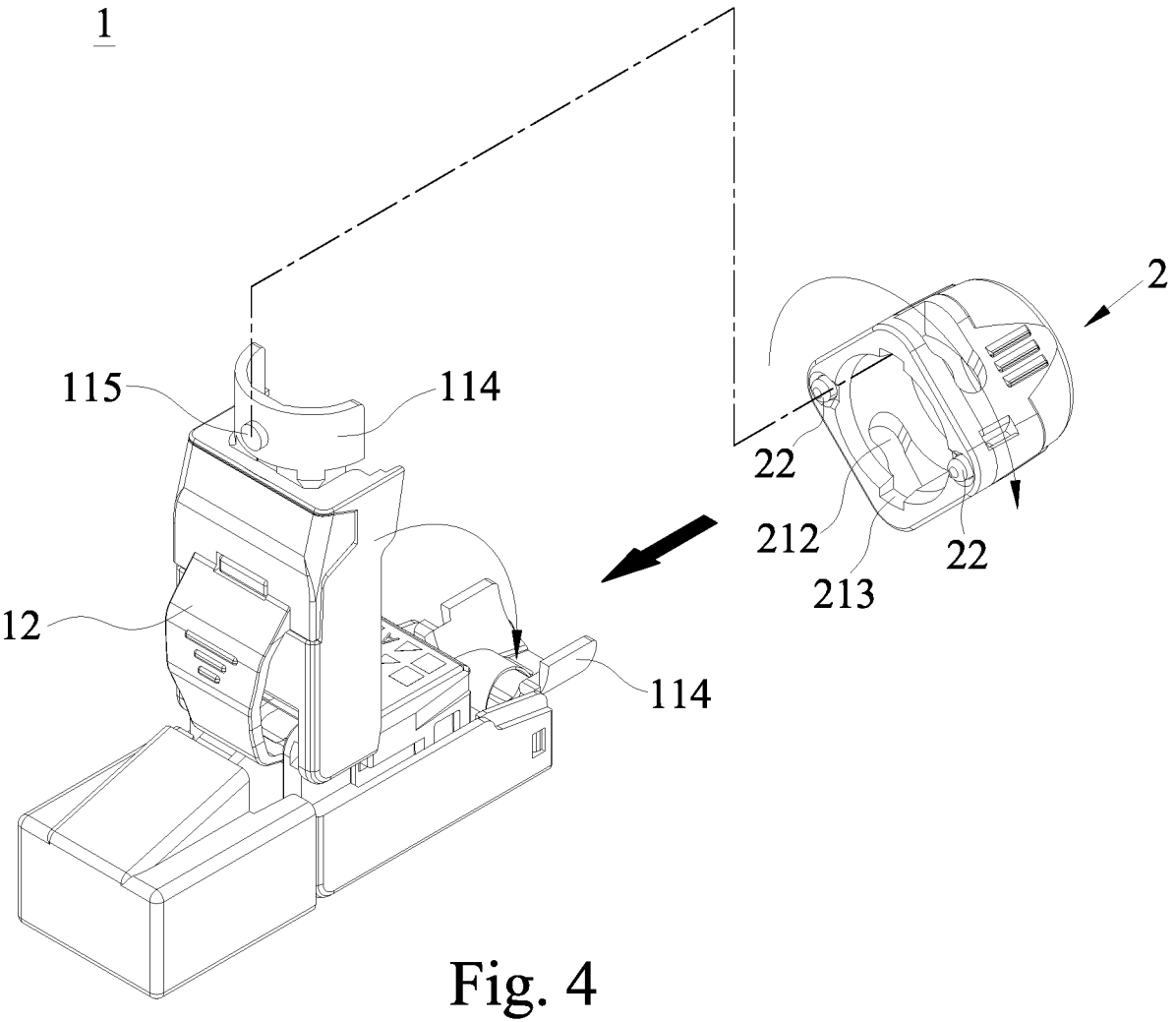
FIG. 4 is a first schematic view of a preferred embodiment of the present invention during assembling.
Figure 5:
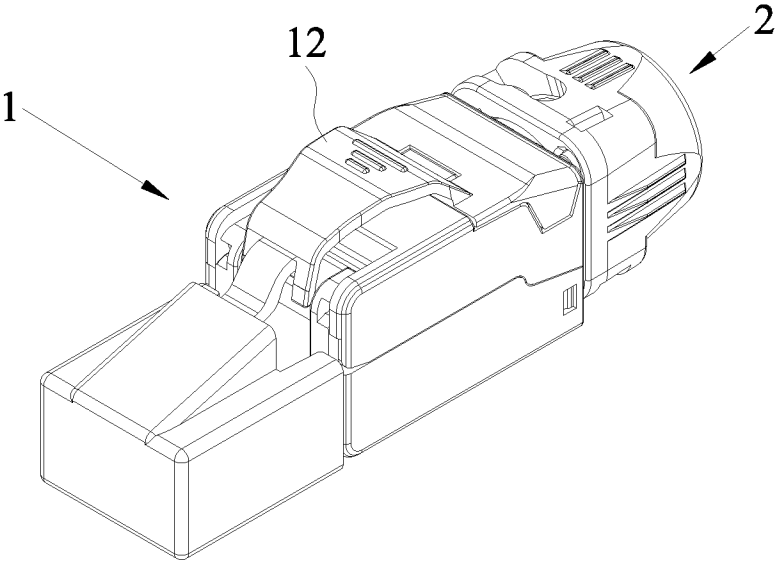
FIG. 5 is a second schematic view of a preferred embodiment of the present invention during assembling.

With reference to FIG. 1-FIG. 5 for schematic views during assembling, a perspective exploded view, and a cross-sectional view after assembling of a preferred embodiment of the present invention. As shown in the figures, a network signal connector 1 comprises a main body 11 and a clamshell 12, and the main body 11 has a connecting portion 111 disposed at a front end of the main body 11 and configured to be corresponsive to a network signal socket (not shown in the figure), and the main body 11 has a wire clamp base 112 and a seal cover 113 installed therein and configured to be corresponsive to a network cable (not shown in the figures) and provided for clamping and fixing the network cable. After the clamshell 12 at the top of the main body 11 is shut, the clamshell 12 presses the wire clamp base 112 and the seal cover 113 to fix the network cable into a position. After the main body 11 and the clamshell 12 are combined to form a circular tubular passage 114 corresponding to the network cable, a pair of protruding pillars 115 are symmetrically disposed outside the circular tubular passage 114, and the rear cover structure 2 is used to lock the main body 11 and the clamshell 12 to prevent loosening and separation, and the rear cover structure 2 comprises a main body 21 and a pair of propping structures 22.

Wherein, the main body 21 has a sleeve-shaped structure with a penetrating passage 211 formed at the middle and configured to be corresponsive to the circular tubular passage 114, and the penetrating passage 211 is in a shape corresponding to the external shape of the circular tubular passage 114, so that the penetrating passage 211 can be sheathed securely on the circular tubular passage 114, and the penetrating passage 211 has a pair of rails 212 disposed on the inner wall surface corresponding to the pair of protruding pillars 115 respectively, and each rail 212 has an opening 213 formed on an end surface of the main body 21 corresponding to the network signal connector 1, so that the pair of openings 213 are disposed at the diagonal positions of the main body 21 respectively, and two mounting holes 214 are formed at the other diagonal positions of the main body 21 respectively. In addition, the penetrating passage 211 has a circular stop portion 2111 disposed therein and configured to be corresponsive to the length of the circular tubular passage 114, so that when the rear cover structure 2 is sheathed on the network signal connector 1, the rear cover structure 2 abuts against the stop portion 2111 precisely to facilitate positioning and rotation.

Each propping structure 22 comprises a propping pillar 221 and an elastic element 222 movably installed into the mounting hole 214, and the front end of each propping pillar 221 is exposed from a surface of the main body 21 by means of the resilience of the elastic element 222.

During assembling, the two protruding pillars 115 are respectively and precisely aligned with the two openings 213 of the tail sleeve structure 2 and pressed, so that the two protruding pillars 115 are moved along the extending direction of each rail 212, and the penetrating passage 211 is sheathed precisely on the circular tubular passage 114. Finally, after the rear cover structure 2 is rotated to a predetermined angle (not shown in the figures), the two protruding pillars 115 are engaged into the two rails 212, and the elastic force of the two propping structures 22 presses the main body 21 to define a secured lock.

It is noteworthy that the interior of each rail 212 has a clamping portion 2121 configured to be corresponsive to the predetermined angle when the rear cover structure 2 is rotated, wherein the predetermined angle falls within a range from 40 degrees to 85 degrees. After each clamping portion 2121 is bent from the rail 212 to an extending distance of the predetermined angle, a socket in a shape corresponding to the shape of the protruding pillar 115 is formed, so that after the rear cover structure 2 is rotated to the predetermined angle, the two protruding pillars 115 fall into the two clamping portions 2121 respectively to define an engagement. In other words, after the rear cover structure 2 has rotated ⅛-¼ round, the locking is completed. In addition, the exterior of the main body 21 is in a rectangular shape corresponding to the shape of an end of the main body 11, and an end of the network cable passing into an end is in a round tubular shape, and the main body 21 has a plurality of ribs 215 disposed on each surface of the main body 21.

What is claimed is:

1. A tail sleeve structure of a network signal connector, wherein the network signal connector comprises a main body and a clamshell, and a front end of the main body has a connecting portion configured to be corresponsive to a network signal socket, and a wire clamp base and a seal cover disposed inside the main body and configured to be corresponsive to a network cable and provided for clamping and fixing the network cable, and after the clamshell at a top of the main body is shut, the wire clamp base and the seal cover are pressed to fix the network cable into a position, and a circular tubular passage corresponding to the network cable being formed after the main body and the clamshell are combined, a pair of protruding pillars are symmetrically disposed outside the circular tubular passage and the tail sleeve is provided for locking the main body and the clamshell for preventing loosening and separation, and a rear cover structure comprises:

a main body, including a sleeve-shaped structure with a penetrating passage in a middle and configured to be corresponsive to the circular tubular passage, so that the penetrating passage can be sheathed on an exterior of the circular tubular passage, and the penetrating passage has a pair of rails disposed on an inner wall surface of the penetrating passage and configured to the pair of protruding pillars respectively, and each rail has an opening formed on an end surface of the main body corresponding to the network signal connector, so that the pair of openings are disposed at diagonal positions of the main body respectively, and two mounting holes are formed at the other diagonal positions of the main body respectively; and a pair of propping structures, each including a propping pillar and an elastic element, and movably installed into the mounting hole, and a front end of each propping pillar being exposed from a surface of the main body by means of a resilience of the elastic element;

during assembling, after the two protruding pillars are aligned precisely and respectively to the two openings of the tail sleeve and pressed, the two protruding pillars are moved along an extending direction of each rail, and the penetrating passage is sheathed on the circular tubular passage precisely, and after a tail cap is rotated to a predetermined angle, the two protruding pillars are engaged into the two rails, and the elastic force of the two propping structures presses on the main body to define a secured lock.

2. The tail sleeve structure of a network signal connector according to claim 1, wherein each rail has a clamping portion disposed therein and configured to be corresponsive to the predetermined angle when the tail cap is rotated, so that after the tail cap has rotated to the predetermined angle, the two protruding pillars fall into the two clamping portions to define an engagement.

3. The tail sleeve structure of a network signal connector according to claim 2, wherein each clamping portion is bent from the rail to an extending distance of the predetermined angle to form a receiving groove in a shape corresponding to the shape of the protruding pillar.

4. The tail sleeve structure of a network signal connector according to claim 3, wherein the predetermined angle falls within a range from 40 degrees to 85 degrees.

5. The tail sleeve structure of a network signal connector according to claim 1, wherein the penetrating passage is in a shape corresponding to the external shape of the circular tubular passage.

6. The tail sleeve structure of a network signal connector according to claim 5, wherein the penetrating passage has a ring-shaped stop portion disposed therein and configured to be corresponsive to the length of the circular tubular passage.

7. The tail sleeve structure of a network signal connector according to claim 1, wherein the exterior of the main body is designed in a substantially rectangular shape and configured to be corresponsive to an end of the main body, and an end in where the network cable passes is designed in a substantially tubular shape.

8. The tail sleeve structure of a network signal connector according to claim 7, wherein each surface of the main body has a plurality of ribs disposed thereon.

* * * * *